US006918642B2

(12) United States Patent
Horigome

(10) Patent No.: US 6,918,642 B2
(45) Date of Patent: Jul. 19, 2005

(54) RECORDING APPARATUS USING FUEL BATTERY

(75) Inventor: Hideo Horigome, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 10/443,770

(22) Filed: May 23, 2003

(65) Prior Publication Data

US 2003/0222929 A1 Dec. 4, 2003

(30) Foreign Application Priority Data

May 29, 2002 (JP) ..... 2002-155877

(51) Int. Cl.[7] ..... B41J 29/38
(52) U.S. Cl. ..... 347/5
(58) Field of Search ..... 347/5, 6, 7, 19, 347/36, 20, 1, 95, 90, 89, 85

(56) References Cited

U.S. PATENT DOCUMENTS

| | | | |
|---|---|---|---|
| 5,182,583 | A | 1/1993 | Horigome et al. |
| 5,631,677 | A | 5/1997 | Horigome et al. |
| 5,673,070 | A | 9/1997 | Nakanishi et al. |
| 6,012,795 | A | 1/2000 | Saito et al. |
| 6,067,101 | A | 5/2000 | Arakawa et al. |

FOREIGN PATENT DOCUMENTS

| | | |
|---|---|---|
| JP | 7-201348 | 8/1995 |
| JP | 11-292341 | 10/1999 |

*Primary Examiner*—Raquel Yvette Gordon
(74) *Attorney, Agent, or Firm*—Fitzpatrick, Cella, Harper & Scinto

(57) ABSTRACT

A recording apparatus employing a fuel battery as a power supply includes an arrangement for collecting substances produced from the fuel battery and/or an arrangement for detecting the amount of fuel remaining in the fuel battery.

24 Claims, 9 Drawing Sheets

RECORDING APPARATUS USING FUEL BATTERY

BACKGROUND OF THE INVENTION

1. Field of the Invention

The present invention relates to an image recording apparatus for recording an image on a recording medium, and more particularly, to a recording apparatus that is supplied with power from a fuel battery or cell to execute a recording operation.

2. Description of the Related Art

Since inkjet recording systems can easily print data in colors and are suitable to reduce noise and cost, they are widely used in printers, facsimiles, and the like.

As host apparatuses such as personal computers and the like are reduced in size, there is a tendency to also reduce in size recording apparatuses such as printers, copy machines, facsimiles, and the like. In particular, since mobile personal computers called note book computers are not provided with a recording apparatus oridinarily, a mobile recording apparatus is necessary to record information by the mobile personal computers outside of an office. Thus, it is required that the mobile recording apparatus be small in size, light in weight and driven by a battery. Since the inkjet recording apparatus can be easily reduced in size, printers of a size that is easy to carry, that is, mobile printers, are employed in many cases. The mobile printer is provided with a storage battery such as a secondary battery, a dry-cell battery, and the like to cope with a requirement for battery drive as disclosed in, for example, Japanese Patent Laid-Open No. 11-292341.

While storage batteries such as secondary batteries, dry-cell batteries, and the like are continuously being improved and the capacity thereof being increased, the capacity has not been yet greatly increased to several or several tens of times, and it is difficult to expect to greatly reduce the size and weight of the recording apparatus using known storage batteries. Further, the secondary battery is troublesome in that it must be charged, whereas the dry-cell battery has a problem in that it impacts the environment because it is disposable, while it need not be charged.

In view of the above circumstances, attention is paid to fuel batteries. The fuel battery generates power by an electrochemical reaction of hydrogen with oxygen through a catalyst and is vigorously studied all over the world with an expectation to serve as a clean energy source for the next generation. Development of fuel batteries has preceded in the fields of electric vehicles and small power generation systems. However, as disclosed in, for example, Japanese Patent Laid-Open No. 07-201348, ultra small fuel batteries, which can be used as a power supply for small electronic equipment such as medical micro-machines, mobile phones, and the like, have recently been made for testing. The fuel battery can generate power that is about ten times larger than that of a lithium-ion battery used in almost all the electronic equipment at present. Further, the fuel battery need not be charged, unlike an ordinary storage battery, and can be used only by being supplied with fuel.

Further, the fuel battery is advantageous in that fuels such as methanol and the like can be obtained at a low cost and the environment is less affected thereby. Accordingly, when a small fuel battery is practically used, it can be applied to a power source of the printer, which can realize a smaller mobile printer that is more friendly to the environment.

However, the fuel battery must discharge carbon dioxide, water, and the like, which are produced in power generation, to the outside of an apparatus, and this is a large problem when the fuel battery is mounted on electronic equipment. To cope with this problem, a method of vaporizing generated water and discharging it as vapor to the outside of the apparatus has been proposed. However, this method is disadvantageous in that cost is increased because a vaporization mechanism is necessary. Further, there is a possibility that the vapor may be liquefied again and reform as dew drops in a low temperature/high humidity atmosphere as in rainy days and the like, thereby causing the recording apparatus to malfunction.

A function for notifying a user of a remaining amount of a battery is very important in battery-driven electronic equipment. If it possible to warn that the remaining amount of the battery is low before the electronic equipment is interrupted by a dead battery, the user can prepare a spare battery in advance and can replace it for the dead battery, thereby the interruption of the electronic equipment during use can be prevented. A method of detecting near depletion of fuel in a fuel battery includes a method of detecting the pressure of a hydrogen gas used in power generation, a method of calculating the amount of power consumption by hardware, and the like.

However, any of these methods has a problem in that the cost and size of electronic equipment is increased. Thus, there is contemplated a method of calculating the amount of power consumption by software. However, this method has a technical problem in that accuracy in detection is low because the remaining amount of the battery is calculated by subtracting the estimated amount of power consumption from a predetermined initial remaining amount and in that this method cannot be used when the remaining amount of a replaced tank is the predetermined initial remaining amount, that is, the replaced tank is filled up.

SUMMARY OF THE INVENTION

Accordingly, the present invention can provide a printer capable of being operated by a small fuel battery by solving the above problems.

To solve the above problems, a recording apparatus for receiving power from a fuel battery and executing recording using a recording head includes a collection means for collecting substances produced by the fuel battery, and a control means for controlling the collection means.

Another recording apparatus of the present invention for receiving power from a fuel battery and recording an image on a recording medium using a recording head for ejecting inks includes a carriage on which a fuel tank of the fuel battery and ink tanks for supplying inks to the recording head are mounted, a remaining amount detection means for detecting the amount of fuel remaining in the fuel tank, a moving means for moving the carriage to cause the remaining amount detection means to execute detection, and a control means for controlling the moving means.

Still another recording apparatus of the present invention for receiving power from a fuel battery and recording an image on a recording medium using a recording head includes a fuel tank for supplying fuel to the fuel battery and ink tanks for supplying inks to the recording head, a scanning means having the recording head mounted thereon and executing scanning reciprocatingly, and a remaining amount detection means for detecting the amount of inks remaining in the ink tanks and the amount of fuel remaining in the fuel tank, wherein the remaining amount detection means is disposed on the scanning means.

Yet another recording apparatus for receiving power from a fuel battery and executing recording using a recording head includes a recovery unit for recovering the recording head and a collection tank for collecting substances produced by the fuel battery and substances captured by the recovery unit from the recording head.

A still further recording apparatus for receiving power from a fuel battery and recording an image on a recording medium using a recording head for ejecting ink includes a fuel tank for supplying fuel to the fuel battery, at least one ink tank for supplying ink to the recording head, a carriage for carrying the recording head, a transmission for reciprocating the carriage carrying the recording head across the recording medium, and a detection unit for detecting the amount of fuel remaining in the fuel tank.

Further objects, features and advantages of the present invention will become apparent from the following description of the preferred embodiments with reference to the attached drawings.

DESCRIPTION OF THE PREFERRED EMBODIMENTS

Embodiments of the present invention will be described below with reference to the drawings.

<First Embodiment>

Figure 1:
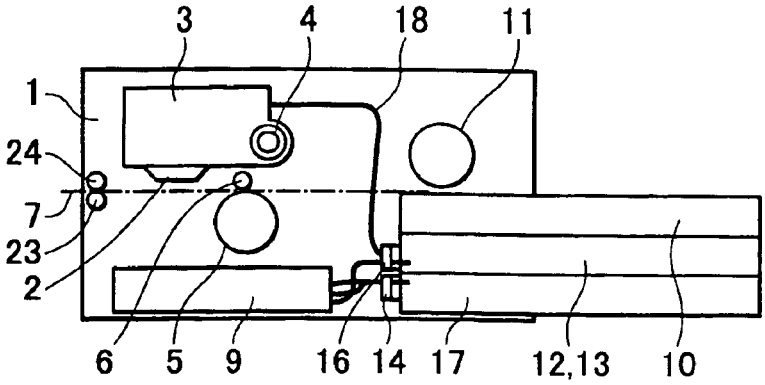
FIG. 1 is a schematic sectional view of an inkjet recording apparatus of a first embodiment.
Figure 2:
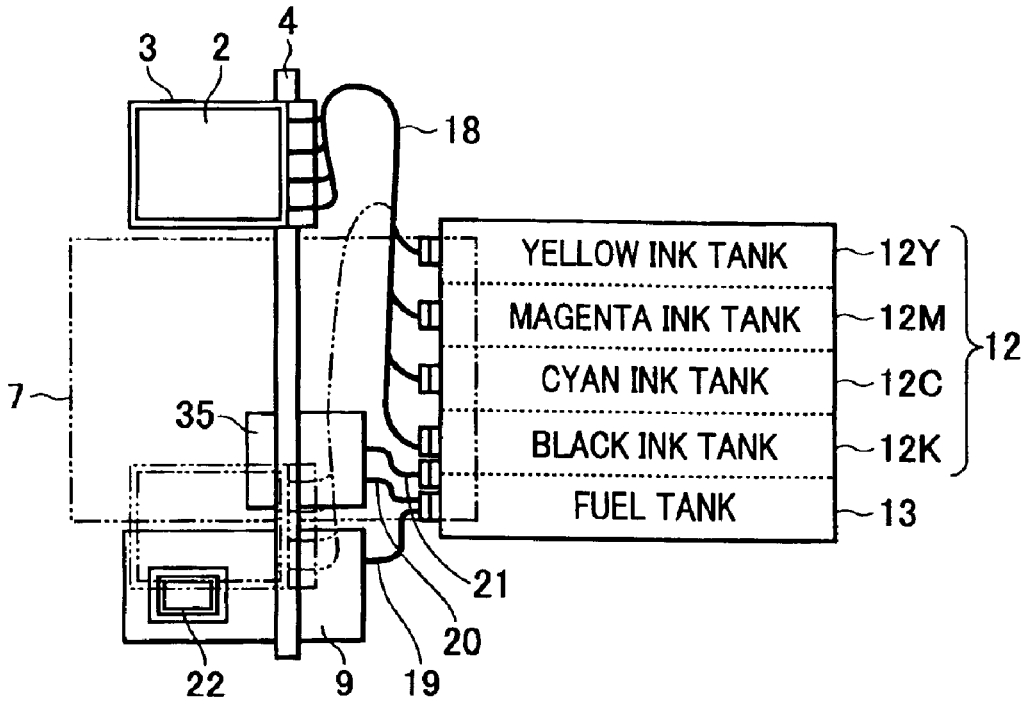
FIG. 2 is a schematic upper view of a recording unit of the inkjet recording apparatus of the first embodiment.

FIG. 1 is a schematic sectional view of an inkjet recording apparatus 1 of the first embodiment 1. FIG. 2 is a schematic upper view of a recording section of the inkjet recording apparatus 1 shown in FIG. 1. In FIGS. 1 and 2, a carriage 3, on which a recording head 2 is mounted, is slidably supported by a guide shaft 4. A drive belt, which is driven by a carriage motor, is attached to the carriage 3 and reciprocatingly driven in a main scan direction.

A recording medium 7 (for example, a recording sheet) is transported on a platen by a transportation roller 5 and a pinch roller 6 that are driven by an LF motor acting as a drive source. At this time, the recording head 2 mounted on the carriage 3 protrudes downward from the carriage 3, and the recording head 2 prints characters on the recording medium 7 with the surface of the recording head, on which ejection ports are formed, facing the recording medium 7 on the platen.

A recovery system unit (recovery means) 9 is disposed at a home position. When the carriage is located at the home position, the recovery system unit 9 prevents faulty ejection of inks, which is caused by the ink in the nozzles of the recording head 2 being evaporated and stuck to walls of the nozzles and by the ink viscosity being increased, by capping the recording head 2 by connecting a suction cap thereto. Further, if the recording head 2 executes faulty ejection, the recording head 2 is capped with the suction cap and the ink in the recording head 2 is suctioned and exhausted by a suction processing mechanism (suction means) that generates a negative pressure by a pump unit. The faulty ejection can be overcome by the above operation.

Each of recording mediums accommodated in a sheet feed cassette 10 is picked up by rotting a sheet feed roller 11 and abutting the medium against a nip between transportation rollers and pinch roller.

Figure 4:
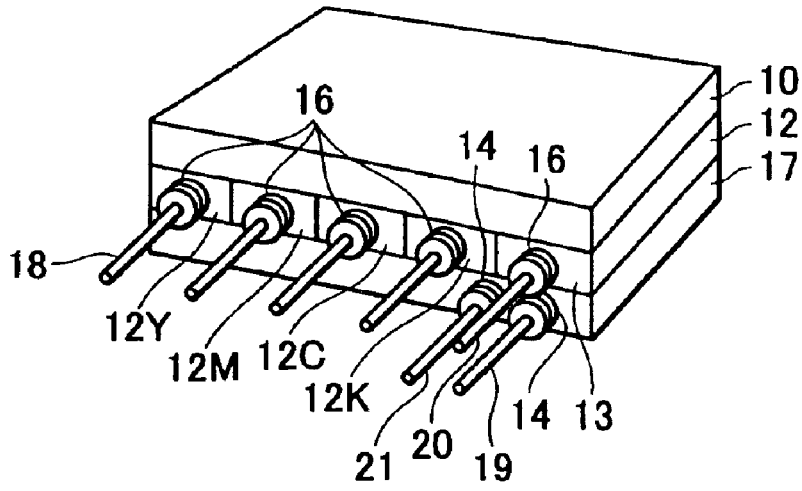
FIG. 4 is a view explaining ink tanks, a fuel tank, and a collection vessel of the inkjet recording apparatus of the first embodiment.

Ink tanks 12 and a fuel tank 13 are disposed below the sheet feed cassette 10. The ink tanks 12 include ink tanks of four colors, that is, black 12K, cyan 12C, magenta 12M, and yellow 12Y tanks. As shown in FIG. 4, each of the ink tanks 12 has an ink supply port 16 and supplies an ink to the recording head 2 through an ink supply tube 18 connected between the ink supply port 16 and an ink receiving port of the inkjet recording apparatus 1. A silicon seal member is inserted into the ink supply port 16 to prevent the leakage of the ink in the ink tank. A needle-like ink receiving tube is disposed in the ink receiving port to improve the hermetically sealed state of the ink receiving port when it is connected. The fuel tank 13 supplies fuel to a main body of a fuel battery 35 through a tube 20 connected to fuel supply pout 18, similarly to the ink tanks 12. The ink tanks (12Y, 12M, 12C, and 12K) and the fuel tank 13 can be mounted on and dismounted from a main body of the inkjet recording apparatus 1.

A waste ink collection means (collection vessel) 17, which accommodates the ink suctioned from the recording head 2 by the suction processing (suction action) executed by the recovery system unit 9, is disposed below the ink tanks 12 and the fuel tank 13. The collection vessel 17 has supply tubes 19, 21 which are connected to receiving ports 14 of a joint portion of vessel 17 and to supply ports of recovery system unit 9 and battery 35, into which seal members are inserted, thereby the supply tubes are connected to the recovery system unit 9 and further to the main body of the fuel battery 35, similarly to the ink tanks 12. With this arrangement, the ink, which is suctioned out of the recording head 2 by the suction processing executed by the recovery system unit 9 is collected into the collection vessel 17 through the tube 19.

Substances (byproducts), for example, water and the like produced when power is generated by the fuel battery 35 are also collected into the collection vessel 17 through the tube 21. The collection vessel 17 is detachably mounted on the main body of the recording apparatus 1, and when the collection vessel 17 is filled with the collected substances, it is replaced with an empty collection vessel, which permits the recording apparatus 1 to be used continuously. Note that when the collection vessel 17 is removed from the main body of the recording apparatus 1, no recording operation is executed and this state is notified to a user through a display unit.

Figure 3:
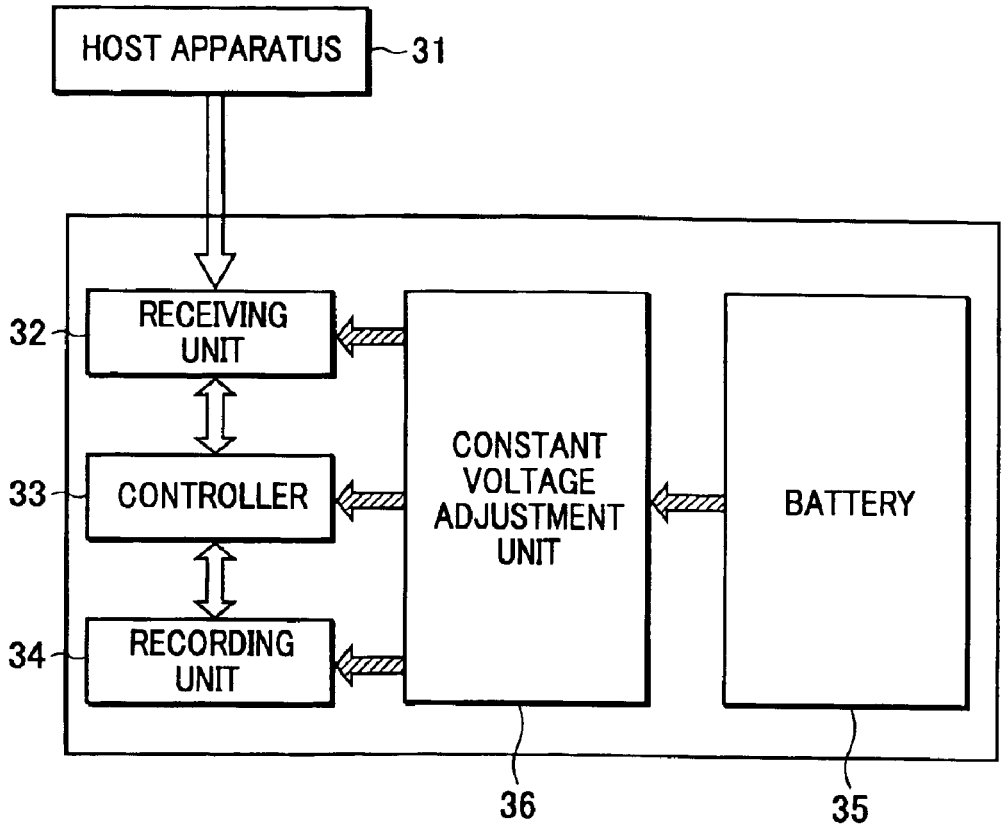
FIG. 3 is a schematic electric block diagram the inkjet recording apparatus of the first embodiment.

Next, an electric arrangement of the recording apparatus 1 will be schematically explained. FIG. 3 is a block diagram of an electric circuit of the inkjet recording apparatus 1 to which the embodiment is applied. A receiving unit 32 formed of a receiving buffer memory and the like receives and stores recording information transmitted by a host apparatus 31 such as a personal computer or the like. A controller 33 analyzes the received recording information, converts it into image recording print data, transmits the data to a recording unit 34 of the recording head 2 and controls recording of an image by controlling motors such as the LF motor, the carriage motor, and the like.

The controller 33 controls the ejection frequencies, the number of drive recording elements, and the like of the recording head 2. Further, the controller 33 counts the number of ink droplets of each ejected color ink and the number of suction operations executed to recover the recording head 2 and converts the amount of consumption of each color ink into a number of ink droplets (a number of pulses).

Further, the controller 33 controls an operation for collecting the substances (for example, water) produced by the fuel battery 35 that generates power (for example, pump actuated to control flow). With this control, the water, which is stored in a member (for example, a tank) capable of temporarily storing water provided with the fuel battery, and the water in a discharge water collection tube are supplied to the collection vessel 17. This control is executed when, for example, the number of recording sheets (recording mediums) on which information has been recorded reaches a predetermined number of sheets. Otherwise, the control may be executed when the amount of consumption of the inks described above reaches a predetermined amount.

In contrast, the output from the fuel battery 35 is supplied to the respective drive sections of the recording apparatus 1 after it is adjusted to one or more constant voltages by a constant voltage adjustment unit 36. A voltage of, for example, 5 volts is supplied to the controller 53 and a voltage of, for example 19 volts is supplied to the recording unit 34 for driving it.

As described above, according to the inkjet recording apparatus 1 of this embodiment, the waste ink collection means for accommodating the ink suctioned from the recording head 2 by the suction processing is also used as the means for collecting the substances produced by the fuel battery when it generates power. Thus, it is not necessary to additionally provide a collection means for collecting the substances produced by the fuel battery in power generation.

Accordingly, there is an advantage that the space and the number of components of the recording apparatus 1 can be suppressed and cost can be reduced. Further, since the collection vessel can be mounted on and dismounted from the the main body of the inkjet recording apparatus 1, the capacity of the vessel can be reduced, which also has an advantage of reducing the size of the overall recording apparatus.

<Second Embodiment>

Figure 5:
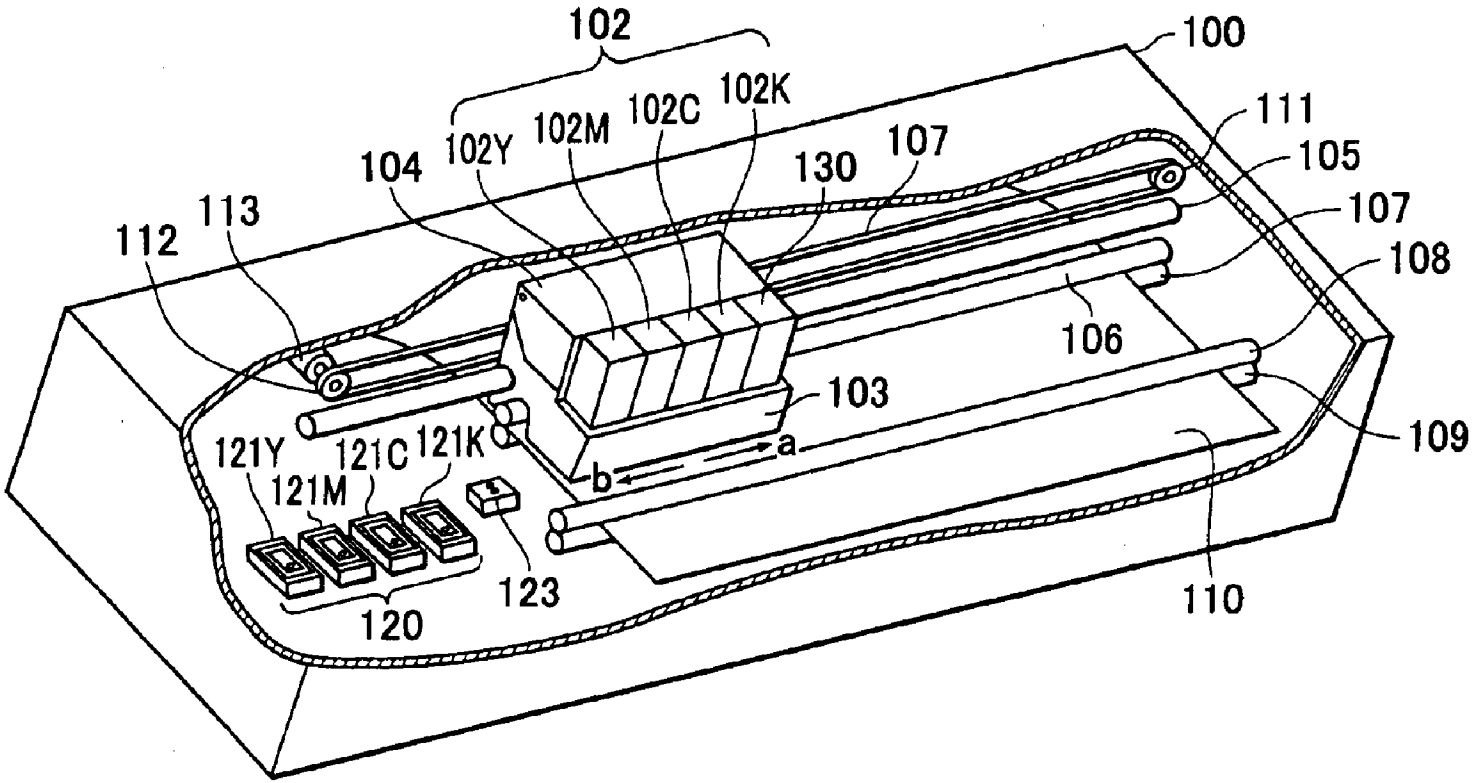
FIG. 5 is a schematic perspective view of an inkjet recording apparatus of a second embodiment.

FIG. 5 is a perspective view showing a schematic arrangement of an inkjet recording apparatus 100 (hereinafter, referred to as the recording apparatus) of a second embodiment.

As shown in FIG. 5, the recording apparatus 100 includes a recording head 102 and a fuel battery cartridge 130 detachably attached to a carriage 103 through a fixing lever 104. The recording head 102 has a plurality of (for example, 4) head cartridges each ejecting ink droplets from a plurality of (for example, 128) ink ejection ports, and the fuel battery cartridge 130 generates power by a fuel containing hydrogen such as alcohol, and the like. The head cartridges and the fuel battery cartridge 130 are accommodated in the fixing lever 104. In this embodiment, four head cartridges 102Y, 102M, 102C, and 102K for ejecting inks of respective colors of yellow (Y), magenta (M), cyan (C), and black (B) are used, and these head cartridges constitute the recording head 102 in its entirety. Dots are recorded on a recording medium such as a recording sheet 110 by the ink droplets ejected from the respective head cartridges, thereby a color image and the like are formed. Note that these head cartridges include ink tanks 102*y*, 102*m*, 102*c*, and 102*k* for accommodating inks that have colors corresponding to the head cartridges. The fuel battery cartridge 130 includes a fuel tank of alcohol and the like.

The rotational force of a carriage motor 113 is transmitted to the carriage 103 through a motor pulley 112, a follower pulley 111, and a timing belt 107 so that the carriage 103 is reciprocatingly moved in the directions of arrows a and b along a guide shaft 105. In contrast, the recording sheet 110 is transported by two sets of transportation rollers 106 and 107, and 108 and 109 disposed upstream and downstream relative to a transporting direction. Further, the back surface of the recording sheet 110 is supported by a platen (not shown) so that a flat recording surface is formed at a position where the recording sheet 110 confronts the ink ejection ports of the recording head 102.

Images and the like are sequentially formed in a prescribed region of the recording sheet 110 (recording medium) by scanning the recording sheet 110 with the recording head 102 as the carriage 103 moves as described above and by transporting the recording sheet 110 by the two sets of the transportation rollers. Note that image data and the like for recording the images and the like is supplied to a drive circuit of the recording head 102 from a control circuit of the recording apparatus 100 through a flexible cable (not shown). In contrast, power for driving the respective sections of the recording apparatus 100 is supplied from the fuel battery cartridge 130 to a power supply circuit of the recording apparatus 100 through a flexible cable and applied to the respective sections of the recording apparatus 100.

As shown in FIG. 5, a photo sensor 123 is disposed adjacent the platen along a reciprocating path of carriage 103 and irradiates light to bottom surfaces of the ink tanks attached to the head cartridges and to the bottom surface of the fuel tank attached to the fuel battery cartridge 130, with the head cartridges and the fuel battery cartridge 130 being mounted on the carriage 103. Further, the photo sensor 123 receives the light reflected from the bottom surfaces of the tanks and measures the reflectances of the ink tanks and the fuel tank as described later. As described above, the photo sensor 123 is positioned to face the respective ink tanks and the fuel tank as the carriage 103 moves and can measure the reflectances of these tanks.

A recovery system unit 120 is disposed at a home position of the recording head 102 as shown in FIG. 5. The recovery system unit 120 includes four caps 121Y, 121M, 121C, and 121K, which are disposed in correspondence with rows of ink ejection ports of each of the four head cartridges, and a pump unit (not shown) connected to respective caps through tubes and the like. The caps 121Y, 121M, 121C, and 121K can be moved in an up/down direction when the carriage 103 approaches them, and when the recording head 102 is located at the home position, the caps come into intimate contact with the ink ejection surfaces of the head cartridges and cover the ink ejection ports thereof (capping).

With this capping operation, when ink in the ink ejection ports evaporate, an increase in viscosity and adherence of the ink can be prevented, thereby faulty ink ejection can be prevented beforehand. Further, when an ink tank is replaced or when faulty ink ejection occurs, a negative pressure is produced in the caps by operating the pump unit in a state in which the capping is executed, thereby suction recovery processing is executed to suction ink out of the ink ejection ports and to introduce fresh ink into the head unit by the suction force produced by the negative pressure.

Figure 7:
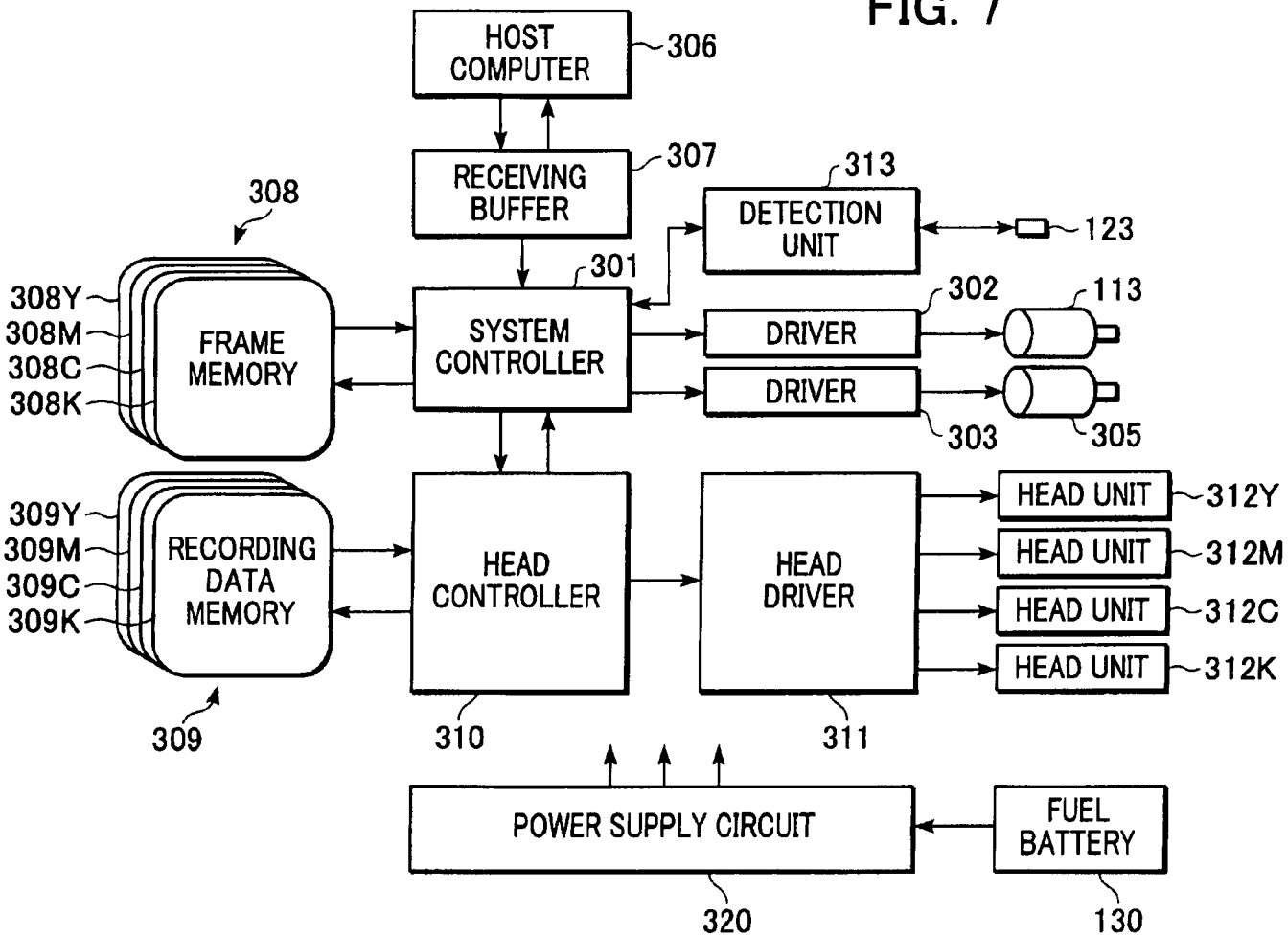
FIG. 7 is a schematic electric block diagram of the inkjet recording apparatus of the second embodiment.

FIG. 7 is a block diagram showing a control arrangement of the recording apparatus 100 explained in FIG. 5. In FIG. 7, reference numeral 301 denotes a system controller for controlling the recording apparatus 100 in its entirety. The system controller 301 includes a micro processor (MPU), a ROM in which a control program is stored, and a RAM used as a work region when the MPU executes various kinds of processing by executing the control program. Reference numeral 302 denotes a driver for driving the carriage motor 113 for moving the carriage 103, and 303 denotes a driver likewise for driving a transportation motor 305 for transporting the recording medium through the transportation rollers. That is, the carriage motor 113 and the transportation motor 305 are driven according to the information as to a speed, a moving distance, and the like supplied from drivers corresponding thereto.

Reference numeral 307 denotes a receiving buffer for temporarily storing recording data supplied from a host computer 306 and stores the data until it is read by the system controller 301.

Reference numeral 308 denotes a frame memory for developing the recording data to bit map data. The frame memory 308 stores the bit map data that is developed based on the data read from the receiving buffer 307 by the system controller 301. The frame memory 308 in this embodiment is divided into four frame memories 308Y, 308M, 308C, and 308K for respective color components, and each frame memory has a capacity capable of storing data to be recorded on a single recording sheet in correspondence to each color component. Reference numeral 309 denotes a recording data memory for storing bit map data for one scan executed by the recording head 102. The recording data memory 309 in this embodiment is divided into four memories 309Y, 309M, 309C, and 309K for the respective color components, similarly to the frame memory 308, and the respective memories have storing capacities proportional to the number of ink ejection ports of the head cartridges 102Y, 102M, 102C, and 102K. It is needless to say that the size of each frame memory is not limited to the above example.

Reference numeral 310 denotes a head controller for controlling the drive of the recording head 102 in response to a command from the system controller 301 and controls, for example, the number of ejection frequencies, the number of drive recording elements, and the like of the recording head 102. Further, the system controller 301 counts the number of ink droplets ejected from head units 312Y, 312M, 312C, and 312K of recoreding head 102 corresponding to the respective color components, the number of suction operations executed to recover the recording head 102 and converts the amounts of consumption of the inks of the respective colors into a number of ink droplets (number of pulses). Reference numeral 311 denotes a head driver for driving the respective head units 312Y, 312M, 312C, and 312K under the control of the head controller 310 so that they eject inks.

Reference numeral 313 denotes a detection unit that is supplied with a signal from the photo sensor 123 and converts the signal into a digital value according to the input value of the signal.

Reference numeral 130 denotes the fuel battery cartridge, and 320 denotes the power supply circuit for supplying the voltage supplied from the fuel battery 130 after adjusting it to voltages suitable for driving the respective sections of the recording apparatus 100.

Figure 6A:
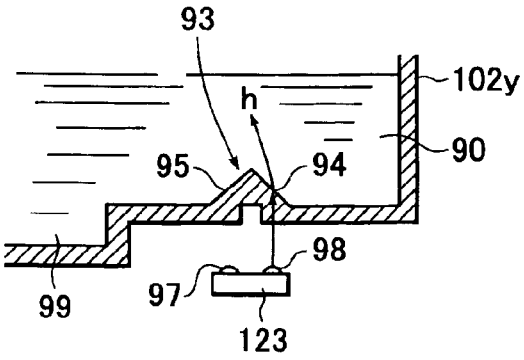
FIGS. 6A and 6B are views explaining a principle of optical remaining amount detection of the inkjet recording apparatus of the second embodiment.
Figure 6B:
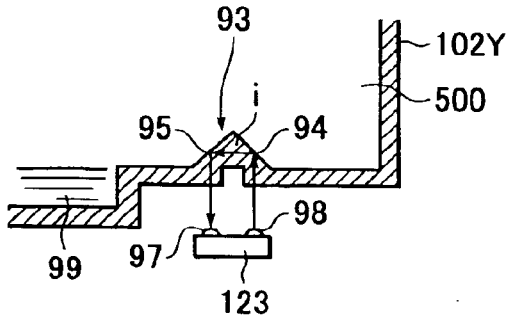

Next, a principle of optical remaining amount detection of the embodiment will be explained. The same principle is applied to all of the ink tanks and the fuel tank, so the case of the yellow ink tank 102*y* will be explained here as an example. FIGS. 6A and 6B are views explaining the principle of the optical remaining amount detection, wherein FIG. 6A shows a state in which a sufficient amount of ink 90 remains, and FIG. 6B shows a state in which a small amount of the ink 90 remains. In these figures, light is irradiated to an inclined surface 94 of a triangular projection 93 on the bottom of the tank 102*y* from a light emitting unit 98 of the photo sensor 123, and reflected light reflected by the inclined surface 94 and another inclined surface 95 is received by a light receiving unit 97. Then, the amount of light reaching the light receiving unit 97 is converted into an electronic signal by a known photoelectronic conversion formula, thereby it is detected that the amount of the ink 90 remaining in the yellow ink tank 102*y* is reduced.

Specifically, when the ink 90 remains in the ink tank in a sufficient amount, the two inclined surfaces 94 and 95 of the triangular projection come into contact with the ink 90 as shown in FIG. 6A. Since the reflective index of the ink 90 is near that of the material (for example, polypropylene) of the ink tank, when the ink tank 102*y* is filled with a sufficient amount of the ink 90, a large amount of light travels in the direction of an arrow h shown in FIG. 6A and only a small amount of light is reflected by the inclined surfaces 94 and 95 and received by the light receiving unit 97.

In contrast, when the ink 90 in the ink tank 102*y* is consumed and remains in a small amount, the inclined surfaces 94 and 95 disposed on the bottom of the tank 102*y* come into contact with the air 500 in the ink cartridge. Since the reflectance of the ink 90 is different from that of air, the amount of reflected light traveling in the direction of an arrow i shown in FIG. 6B is increased and a large portion of the reflected light in the direction of the arrow i is further reflected and reaches the light receiving unit 97.

Accordingly, the amount of light that reaches the light receiving unit 97 increases. Note that since the bottom surface of the tank is formed stepwise and the triangular projection is formed on an upper stage, a lower stage 99 of the tank acts as a reserve tank. As described above, whether or not the ink 90 remaining in the yellow ink tank 102*y* is reduced can be detected by the amount of received light. The amount of fuel remaining in the fuel tank can be also detected by the same method as that of the remaining ink.

When the optical photo sensor 123 is used, the materials of the ink tanks and the fuel tank must be transparent. Further, when the tanks have a property for transmitting visible light therethrough, there is an advantage that a user can visually confirm the types and the remaining amounts of the inks and the remaining amount of the fuel. Further, it is preferable that the photo sensor 123 emits infrared rays and that the light receiving unit is provided with a filter for reducing visible light in order to reduce the influence of illumination and the like in an environment in which a printer is installed. With either of visible light and infrared rays, a prism executes desired transmitting or reflecting action depending on whether or not the ink exists.

The ink tanks and the fuel tank are mounted on the carriage 103 as described above and scanned along the guide shaft 105 slidably engaged therewith and a support shaft.

Further, as shown in FIG. 5, the reflection type photo sensor 123, in which an LED element and a light receiving element are integrally arranged, is disposed at a predetermined position in the scan direction of the carriage 103. When the carriage 103 is moved and a tank to be detected reaches a position above (for example, just above) the photo sensor 123, the carriage 103 is stopped and a remaining amount is detected by the above principle.

When, for example, the remaining amounts of the inks and the remaining amount of the fuel are to be detected, the carriage 103 first moves such that the ink tank 102*y* is located above the photo sensor 123, and the amount of the ink remaining in the yellow ink tank 102*y* is detected. Next, the carriage 103 moves such that the ink tank 102*m* is located above the photo sensor 123, and the amount of the ink remaining in the ink tank 102*m* is detected. Thereafter, the amounts of the inks remaining in the ink tanks 102*c* and 102*k* and the amount of the fuel remaining in the fuel tank are sequentially detected.

When only the remaining amounts of the inks are to be detected, the carriage 103 is moved such that the ink tanks 102*y,* 102*m,* 102*c,* and 102*k* are sequentially located above the photo sensor 123, and the remaining amounts of the respective inks are detected.

Further, when only the remaining amount of the fuel is to be detected, the carriage 103 is moved such that the fuel tank is located at a position above the photo sensor 123, and the remaining amount of the fuel is detected. These controls are executed, for example, when the number of recording sheets (recording mediums), onto which data has been recorded, reaches a predetermined number or when a command is received from a host apparatus. When the command is detected, the result of detection is displayed on a display unit (not shown) of the recording apparatus 100 or issued as a response to the command.

As described above, according to the second embodiment, since the photo sensor for detecting the remaining amounts of the inks can also act as the sensor for detecting the amount of fuel remaining in the fuel battery, the amount of fuel remaining in the fuel battery can be detected without increasing the cost and size of the recording apparatus 100.

<Third Embodiment>

Figure 8:
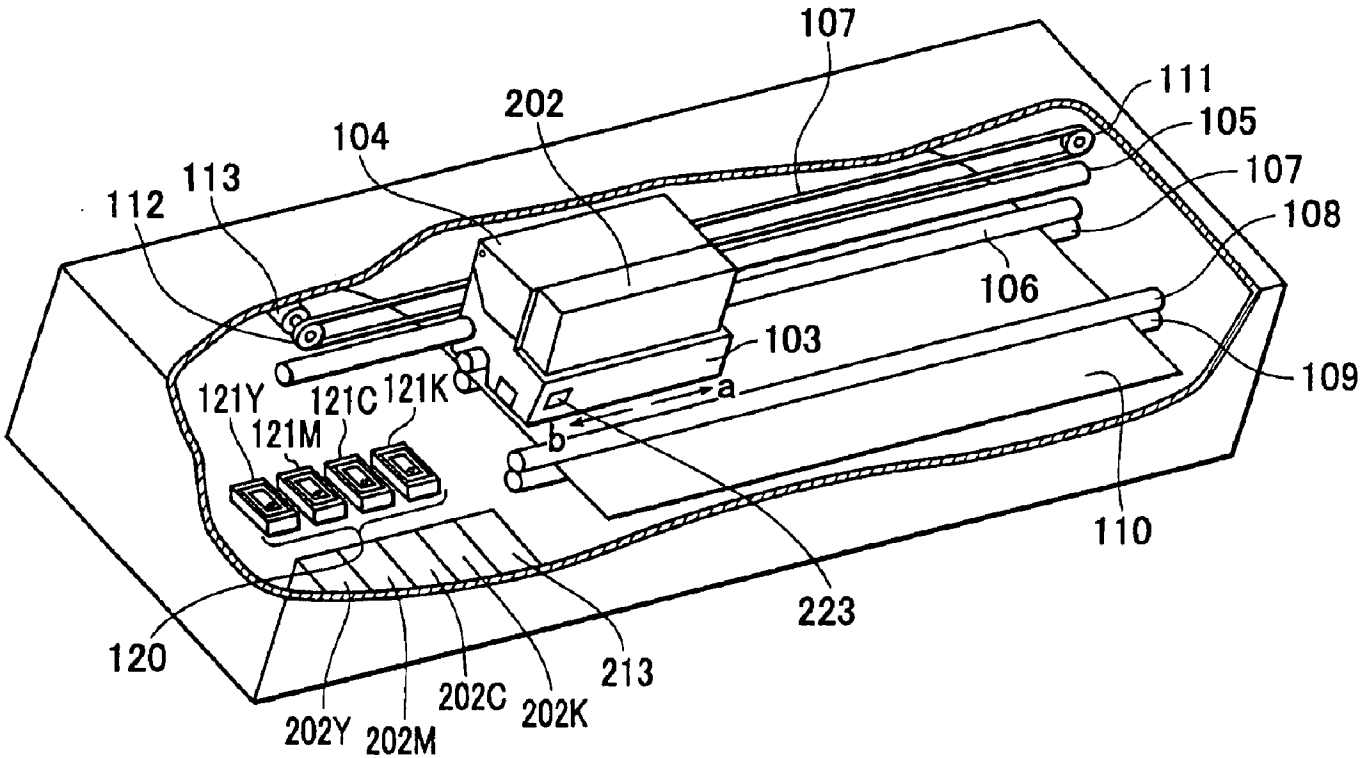
FIG. 8 is a schematic perspective view of an inkjet recording apparatus of a third embodiment.

FIG. 8 shows a recording apparatus of a third embodiment. The recording apparatus includes ink tanks 202Y, 202M, 202C, and 202K and fuel tank 213 disposed in the vicinity of the home position of a carriage 103, and inks are supplied to a recording head 202 mounted on the carriage 103 through tubes and the like.

In this embodiment, a photo sensor 223 is mounted on carriage 103 so as to face the respective ink tanks 202Y, 202M, 202C, and 202K and the fuel tank 213. Then, the amounts of the inks remaining in the recording ink tanks and the amount of fuel remaining in the fuel tank are sequentially detected by the photo sensor 223 mounted on the carriage 103 by moving the carriage 103.

The remaining amount detection processing is executed by, for example, the optical detection system explained in the second embodiment. Further, movement of the carriage 103 is controlled to detect the respective ink tanks and the fuel tank, to detect only the respective ink tanks, on to detect only the fuel tank, as described in the second embodiment.

As described above, according to the third embodiment, since the photo sensor 223 for detecting the remaining amounts of the inks can also act as the sensor for detecting the amount of fuel remaining in the fuel battery, the amount of the fuel remaining in the fuel battery can be detected without increasing the cost and size of the recording apparatus. This is effective when the ink tanks 202Y, 202M, 202C, and 202K and the fuel tank 213 cannot be mounted on the carriage 103 because they have a large size.

While it has been described in the first to third embodiments that the liquid ejected from the recording head is ink, the present invention does not limit the liquid to ink. For example, a processing liquid, which is ejected to a recording medium to enhance the fixing property and the water resistance of a recorded image, may be accommodated in the ink tanks.

Further, while the number of ink ejection ports is set to 128 as an example in the above description, such number is not limited to 128 and may be 64, 256, and the like.

Figure 9:
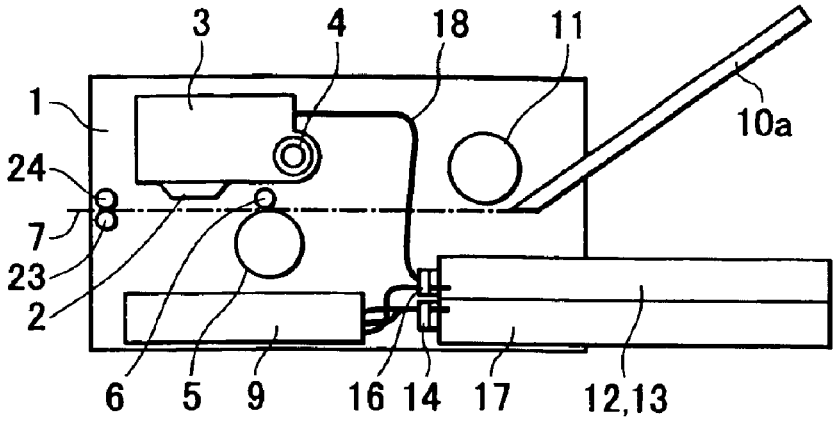
FIG. 9 is view showing a modification of the inkjet recording apparatus of the first embodiment.

Further, the present invention can be also applied to a recording apparatus provided with an ordinary automatic sheet feeder (ASF) 10*a* as shown in FIG. 9 as a modification of the recording apparatus explained in the first embodiment. In this modification, recording mediums are fed from the automatic sheet feeder 10*a*. In FIG. 9, the same components as those shown in FIG. 1 are denoted by the same reference numerals and the description thereof is omitted.

The embodiments described above can particularly achieve recording having high density and excellent resolution by employing a means (for example, electrothermal transducer, laser beams, and the like) for generating thermal energy as energy used to eject inks and a system for changing the state of the inks by the generated thermal energy among various inkjet recording systems.

Further, a method of ejecting inks by means of, for example, a piezo element may be employed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such moifications and equivalent structures and functions.

What is claimed is:

1. A recording apparatus for receiving power from a fuel battery and recording an image on a recording medium using a recording head for ejecting inks, said apparatus comprising:

collection means for collecting substances produced by the fuel battery and collecting ink that is not used in the formation of an image; and control means for controlling said collection means.

2. A recording apparatus according to claim 1, wherein the recording head comprises a plurality of recording elements each including an electrothermal transducer for generating thermal energy as energy for ejecting ink.

3. A recording apparatus according to claim 1, further comprising a carriage for mounting the fuel battery and the recording head, wherein said collection means is disposed separate from said carriage.

4. A recording apparatus according to claim 1, further comprising calculation means for calculating a consumption amount of the ink, wherein said control means controls execution of said collection means when the consumption amount of the ink reaches a predetermined amount.

5. A recording apparatus according to claim 1, further comprising calculation means for calculating a number of recorded recording media, wherein said control means controls execution by said collection means when the number of recorded recording media reaches a predetermined number.

6. A recording apparatus according to claim 1, wherein the fuel includes alcohol, which contains hydrogen.

7. A recording apparatus for receiving power from a fuel battery and recording an image on a recording medium using a recording head for ejecting ink, said apparatus comprising:

a carriage on which a fuel tank of the fuel battery and an ink tank for supplying ink to the recording head are mounted;

remaining amount detection means for detecting the amount of fuel remaining in the fuel tank and the amount of ink remaining in the ink tank, said remaining amount detection means comprising a light emitting element for irradiating infrared rays and a light receiving element for receiving the infrared rays;

moving means for moving said carriage to allow said remaining amount detection means to execute detection; and control means for controlling said moving means.

8. A recording apparatus according to claim 7, wherein said fuel tank comprises reflection means for reflecting the infrared rays irradiated from said light emitting element when said fuel tank is filled to at least a predetermined level.

9. A recording apparatus according to claim 7, wherein the recording head comprises a plurality of recording elements each including an electrothermal transducer for generating thermal energy as energy for ejecting ink.

10. A recording apparatus according to claim 7, wherein said control means switches and executes operations for detecting only the remaining amount of fuel in the fuel tank, for detecting only the remaining amount of ink in the ink tank, and for detecting the remaining amount of fuel in the fuel tank and the remaining amount of ink in the ink tank.

11. A recording apparatus for receiving power from a fuel battery and recording an image on a recording medium using a recording head, said apparatus comprising:

a fuel tank for supplying fuel to the fuel battery and an ink tank for supplying ink to the recording head;

scanning means having the recording head mounted thereon and executing scanning reciprocatingly with respect to said fuel tank and said ink tank; and remaining amount detection means for detecting the amount of ink remaining in said ink tank and the amount of fuel remaining in said fuel tank, wherein said remaining amount detection means is disposed on said scanning means.

12. A recording apparatus according to claim 11, wherein said remaining amount detection means comprises a light emitting element for irradiating infrared rays and a light receiving element for receiving the infrared rays.

13. A recording apparatus according to claim 12, wherein said fuel tank and said ink tank each comprises reflection means for reflecting the infrared rays irradiated from said light emitting element when the corresponding tank is filled to at least a predetermined level.

14. A recording apparatus according to claim 11, wherein the recording head comprises a plurality of recording elements each including an electrothermal transducer for generating thermal energy as energy for ejecting ink.

15. A recording apparatus according to claim 11, further comprising control means for controlling any of operations with said scanning means, an operation for detecting only the remaining amount of fuel in said fuel tank, an operation for detecting only the remaining amount of ink in said ink tank, and an operation for detecting the remaining amount of fuel in said fuel tank and the remaining amount of ink in said ink tank.

16. A recording apparatus for receiving power from a fuel battery and executing recording using a recording head, said apparatus comprising:

a recovery unit for recovering the recording head; and a collection tank for collecting substances produced by the fuel battery and substances captured by said recovery unit from the recording head.

17. A recording apparatus according to claim 16, further comprising a carriage for carrying the recording head and the fuel battery, wherein said collection tank is disposed separate from said carriage.

18. A recording apparatus according to claim 16, wherein the recording head comprises a plurality of recording elements each including an electrothermal transducer for generating thermal energy as energy for ejecting ink.

19. A recording apparatus for receiving power from a fuel battery and recording an image on a recording medium using a recording head for ejecting ink, said apparatus comprising:

a fuel tank for supplying fuel to the fuel battery;

at least one ink tank for supplying ink to the recording head;

a carriage for carrying the recording head;

a transmission for reciprocating said carriage carrying the recording head across the recording medium; and a detection unit for detecting the amount of fuel remaining in said fuel tank, wherein said detection unit is mounted on said carriage, and said fuel tank and said at least one ink tank are disposed in the vicinity of a home position of said carriage.

20. A recording apparatus according to claim 19, further comprising a controller for controlling said detection unit and said transmission.

21. A recording apparatus according to 19, wherein said detection unit further detects the amount of ink remaining in said at least one ink tank.

22. A recording apparatus according to claim 19, wherein said detection unit comprises a light emitting element for irradiating infrared rays and a light receiving element for receiving the infrared rays.

23. A recording apparatus according to claim 22, wherein said fuel tank and said at least one ink tank each comprises reflection means for reflecting the infrared rays irradiated from said light emitting element when the corresponding tank is filled to at least a predetermined level.

24. A recording apparatus according to claim 19, wherein the recording head comprises a plurality of recording elements each including an electrothermal transducer for generating thermal energy as energy for ejecting ink.

* * * * *